US012702241B2

(12) United States Patent
Joardar et al.

(10) Patent No.: US 12,702,241 B2
(45) Date of Patent: Aug. 11, 2026

(54) REFRIGERATED DISPLAY CABINET INCLUDING MICROCHANNEL HEAT EXCHANGERS

(71) Applicant: Carrier Corporation, Palm Beach Gardens, FL (US)

(72) Inventors: Arindom Joardar, Palm Beach Gardens, FL (US); Christophe Valle, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 516 days.

(21) Appl. No.: 16/405,851

(22) Filed: May 7, 2019

(65) Prior Publication Data

US 2020/0352359 A1 Nov. 12, 2020

(51) Int. Cl.
*A47F 3/04* (2006.01)

(52) U.S. Cl.
CPC ..... *A47F 3/0486* (2013.01); *A47F 3/0408* (2013.01); *A47F 3/0447* (2013.01)

(58) Field of Classification Search
CPC ..... F25D 23/006; F25D 11/02; F25D 17/067; F25B 5/02; F25B 2339/0242; F25B 2339/02; F25B 31/001; F28F 2260/02; F28F 2250/08; F28F 1/006; F28F 7/163; F28F 7/08
See application file for complete search history.

(56) References Cited

U.S. PATENT DOCUMENTS

| | | | |
|---|---|---|---|
| 2,494,481 | A | 1/1950 | MacMaster et al. |
| 2,657,546 | A | 11/1953 | Smith |
| 2,672,735 | A | 3/1954 | Fusselman |
| 2,750,758 | A | 6/1956 | Hoye et al. |
| 2,838,809 | A | 6/1958 | Zeolla et al. |
| 3,091,942 | A | 6/1963 | Dickson et al. |
| 3,103,796 | A | 9/1963 | Dickson et al. |
| 3,111,817 | A | 11/1963 | Solley, Jr. |
| 3,186,185 | A | 6/1965 | Bently et al. |
| 3,444,698 | A | 5/1969 | Lorenz |
| 3,462,966 | A | 8/1969 | Reid et al. |
| 3,531,945 | A | 10/1970 | Brennan |

(Continued)

FOREIGN PATENT DOCUMENTS

| | | |
|---|---|---|
| BR | 102015028925 | 5/2017 |
| CN | 86103298 | 11/1986 |

(Continued)

OTHER PUBLICATIONS

US 8,764,130 B1, 07/2014, Pack et al. (withdrawn)

(Continued)

*Primary Examiner* — David J Teitelbaum
(74) *Attorney, Agent, or Firm* — Carlson, Gaskey & Olds, P.C.

(57) ABSTRACT

A refrigerated merchandiser includes a product display area having multiple shelves. An air return passage is defined below the shelves. A first fan is disposed at a downstream end of the air return passage. An air distribution passage is connected to an outlet of the fan and is disposed behind the shelves. A top passage is disposed above the shelves. At least one microchannel evaporator at least partially surrounds the first fan. The at least one microchannel evaporator includes at least one bend.

27 Claims, 7 Drawing Sheets

(56) References Cited

U.S. PATENT DOCUMENTS 3,577,744 A 5/1971 Mercer
3,848,426 A 11/1974 Whitney
3,893,307 A 7/1975 Jacobs
3,898,864 A 8/1975 Steelman
4,004,370 A 1/1977 Heaney
4,009,586 A 3/1977 Skvarenina
4,035,608 A 7/1977 Stromquist et al.
4,117,698 A 10/1978 Vogel
4,127,765 A 11/1978 Heaney
4,135,369 A * 1/1979 Allgeyer ..... A47F 3/04 62/251
4,150,550 A 4/1979 Mercer, Sr.
4,197,718 A 4/1980 Abraham et al.
4,245,482 A 1/1981 Abraham
4,248,015 A 2/1981 Stromquist et al.
4,265,090 A 5/1981 Abraham
4,272,969 A 6/1981 Schwitzgebel
4,302,946 A 12/1981 Ibrahim
4,312,190 A 1/1982 Ibrahim et al.
4,319,463 A 3/1982 Ljung
4,341,082 A 7/1982 Ibrahim
4,347,710 A 9/1982 Ibrahim
4,375,155 A 3/1983 Rosanio et al.
4,389,852 A 6/1983 Abraham
4,389,856 A 6/1983 Ibrahim
4,414,822 A 11/1983 Ibrahim
4,474,017 A 10/1984 Prada
4,592,209 A 6/1986 Casanova et al.
4,741,172 A 5/1988 Aoki
4,750,335 A 6/1988 Wallace et al.
4,782,666 A 11/1988 Costan
4,855,567 A 8/1989 Mueller
4,879,881 A 11/1989 Madigan
4,938,034 A 7/1990 Rosanio et al.
4,949,554 A 8/1990 Branz et al.
4,998,382 A 3/1991 Kostos et al.
5,009,080 A 4/1991 Naganuma et al.
5,031,413 A 7/1991 Tsuihiji et al.
5,097,642 A 3/1992 Richardson et al.
5,203,175 A 4/1993 Farrey et al.
5,329,736 A 7/1994 Sodervall
5,606,863 A 3/1997 Kicklighter et al.
5,704,221 A 1/1998 Lego
5,727,393 A 3/1998 Mahmoudzadeh
5,743,098 A * 4/1998 Behr ..... A47F 3/0408 62/80
5,778,689 A 7/1998 Beatenbough
5,867,994 A 2/1999 Kopko
5,931,013 A 8/1999 Wickman
6,144,017 A 11/2000 Millett et al.
6,151,904 A 11/2000 Jin
6,185,958 B1 2/2001 Wightman
6,311,512 B1 11/2001 Fung et al.
6,435,630 B1 8/2002 Anin et al.
6,460,372 B1 10/2002 Fung et al.
6,547,346 B2 4/2003 Topper et al.
6,615,593 B2 9/2003 Thurman
6,718,778 B2 4/2004 Lawrence
6,912,864 B2 * 7/2005 Roche ..... A47F 3/0447 62/256
6,981,385 B2 1/2006 Arshansky et al.
7,003,920 B1 2/2006 Messere et al.
7,207,181 B2 4/2007 Murray et al.
7,275,376 B2 10/2007 Swofford et al.
7,340,907 B2 3/2008 Vogh, III
7,367,198 B2 5/2008 Behr
7,614,249 B2 11/2009 Hu
7,891,153 B2 2/2011 Cording
7,891,154 B2 2/2011 Cording
7,905,101 B2 3/2011 Sunderland et al.
7,921,904 B2 * 4/2011 Matter ..... F28D 1/0471 165/150
7,997,094 B2 8/2011 Zangari et al.
8,057,615 B2 11/2011 Grussaute-Nghiem et al.
8,104,302 B2 1/2012 Hayase et al.
8,151,587 B2 4/2012 Chiang et al.
8,215,921 B2 7/2012 Coonrod
8,250,873 B2 8/2012 Yoon et al.
8,359,876 B2 1/2013 Esformes
8,534,006 B2 9/2013 Roche et al.
8,539,783 B1 9/2013 Bunch
8,613,161 B2 12/2013 Nicholson et al.
8,677,771 B2 3/2014 Li et al.
8,769,970 B2 7/2014 Fung et al.
8,776,443 B2 7/2014 Bienick
8,997,507 B2 4/2015 Boarman
9,046,294 B2 6/2015 Lee et al.
9,157,675 B2 10/2015 Howington et al.
9,217,600 B2 12/2015 Malisi
9,456,705 B2 10/2016 Zangari et al.
9,578,977 B2 2/2017 Smith
9,964,350 B2 5/2018 Rees et al.
10,039,390 B2 8/2018 Artwohl et al.
2001/0003248 A1 6/2001 Otto et al.
2003/0178188 A1 * 9/2003 Coleman ..... F28F 1/022 165/164
2005/0132744 A1 6/2005 Rohrer et al.
2005/0229614 A1 10/2005 Ansted
2006/0103269 A1 5/2006 Artwohl et al.
2007/0077399 A1 4/2007 Borowiec et al.
2007/0089454 A1 * 4/2007 Shapiro ..... A47F 3/04 62/434
2007/0289323 A1 12/2007 Swofford et al.
2008/0104973 A1 5/2008 Hall et al.
2009/0205351 A1 8/2009 Fung
2010/0199686 A1 8/2010 Taras et al.
2010/0200150 A1 8/2010 Ougitani et al.
2010/0300127 A1 12/2010 Gu et al.
2011/0302945 A1 * 12/2011 Howington ..... A47F 3/0447 62/256
2012/0067072 A1 3/2012 Malwitz et al.
2013/0213073 A1 * 8/2013 Fritz ..... F28D 1/05383 62/255
2014/0069125 A1 3/2014 Chikkakalbalu et al.
2014/0260360 A1 9/2014 Rasch
2015/0285551 A1 10/2015 Aiken et al.
2016/0360900 A1 12/2016 Holst et al.
2017/0020305 A1 1/2017 Fischer
2017/0030658 A1 * 2/2017 Liu ..... F28F 1/22
2017/0196376 A1 * 7/2017 Leonard ..... A47F 3/0447
2017/0208966 A1 7/2017 Reichert

FOREIGN PATENT DOCUMENTS

CN 1050604 4/1991
CN 2223463 3/1996
CN 1311420 9/2001
CN 2583582 10/2003
CN 2583584 10/2003
CN 2583585 10/2003
CN 101093129 12/2007
CN 102297565 12/2011
CN 102379580 3/2012
CN 104654671 5/2015
CN 204478635 7/2015
CN 204923650 12/2015
CN 205037628 2/2016
CN 205448463 8/2016
CN 205843415 U 12/2016
CN 106595196 4/2017
CN 10693186 7/2017
CN 107101436 8/2017
CN 207455994 6/2018
CN 106545269 9/2018
DE 2934457 3/1981
EP 0527500 2/1993
EP 0717945 6/1996
EP 1029478 8/2000
EP 1203551 5/2002
EP 1414327 5/2004
EP 2310773 4/2011
EP 3460365 3/2019
FR 1282235 1/1962

(56) References Cited

FOREIGN PATENT DOCUMENTS

| | | |
|---|---|---|
| FR | 1386573 | 1/1965 |
| FR | 2443228 | 7/1980 |
| FR | 2488500 | 2/1982 |
| FR | 2525886 | 11/1983 |
| GB | 796626 | 6/1958 |
| GB | 2167846 | 6/1986 |
| GB | 2210683 | 6/1989 |
| IN | 2690DEL2010 | 11/2012 |
| JP | H10253229 | 9/1998 |
| JP | 2000018796 | 1/2000 |
| JP | 2004000372 | 1/2004 |
| KR | 1019990038394 | 6/1996 |
| WO | 0053062 | 9/2000 |
| WO | 2006087690 | 8/2006 |
| WO | 2015165512 | 11/2015 |
| WO | 2018034846 | 2/2018 |

OTHER PUBLICATIONS

European Search Report for Application No. 20173036.3 dated Sep. 9, 2020.
EPO Official Action for EP 20173036.3 mailed Jan. 2, 2024.

* cited by examiner

REFRIGERATED DISPLAY CABINET INCLUDING MICROCHANNEL HEAT EXCHANGERS

TECHNICAL FIELD

The present disclosure relates generally to refrigerated display cabinets, and more specifically to a microchannel heat exchanger configuration for the medium-temperature refrigerated merchandisers.

BACKGROUND

In practice, the grocery stores and supermarkets use refrigerated merchandisers of different types, which may be open or with doors, for displaying and presenting fresh food and beverages to the customers while maintaining a temperature of the products below a predefined threshold. In order to maintain the low temperature, cold air is circulated to the product display area of the cabinet by passing airflow over a heat exchanger surface of an evaporator. A cold refrigerant is pumped through the internal passages of the tubes which absorb the heat from the air via fins and tube surfaces and changes from a liquid phase to a vapor phase in the process. As a result the temperature of the air passing through the evaporator is lowered. One or more fans are typically included in the base of the refrigerated display cabinet and drive cold air through the heat exchanger and into the product display area of the merchandiser.

SUMMARY OF THE INVENTION

In one exemplary embodiment a refrigerated merchandiser includes a product display area comprising a plurality of shelves, an air return passage defined below the plurality of shelves, a first fan disposed at a downstream end of the air return passage, an air distribution passage connected to an outlet of the fan and disposed behind the plurality of shelves and a top passage disposed above the plurality of shelves, and at least one microchannel evaporator at least partially surrounding the first fan, wherein the at least one microchannel evaporator includes at least one bend.

In another example of the above described refrigerated merchandiser the at least one microchannel evaporator comprises a single continuous bend.

In another example of any of the above described refrigerated merchandisers the at least one microchannel evaporator comprises a first straight portion and a second straight portion, the first straight portion being connected to the second straight portion via a bend.

Another example of any of the above described refrigerated merchandisers further includes a second fan at the downstream end of the air return passage, wherein the at least one microchannel evaporator at least partially surrounds the second fan.

In another example of any of the above described refrigerated merchandisers the at least one microchannel evaporator includes a first microchannel evaporator partially surrounding the first fan and a second microchannel evaporator partially surrounding the second fan.

In another example of any of the above described refrigerated merchandisers an outlet of the first microchannel evaporator is connected to an inlet of the second microchannel evaporator such that the first and second microchannel evaporators are arranged in series.

In another example of any of the above described refrigerated merchandisers each of the first and second microchannel evaporators are A-coil microchannel heat exchangers.

In another example of any of the above described refrigerated merchandisers each of the first and second microchannel evaporators are defined by a single bend portion and a lack of straight portions.

In another example of any of the above described refrigerated merchandisers the at least one microchannel evaporator includes a single microchannel evaporator including a first bend defining a first peak, a second bend defining a second peak, and a third bend defining a valley between the first bend and the second bend.

In another example of any of the above described refrigerated merchandisers further includes a first straight portion connecting the first bend to the third bend and a second straight portion connecting the third bend to the second bend.

In another example of any of the above described refrigerated merchandisers the first bend is connected directly to the third bend and the third bend is connected directly to the second bend.

In another example of any of the above described refrigerated merchandisers the at least one microchannel evaporator is positioned relative to the first fan such that a physical orientation of the at least one microchannel evaporator matches localized airflows generated by the first fan.

In another example of any of the above described refrigerated merchandisers the first fan is an axial flow fan.

In another example of any of the above described refrigerated merchandisers the microchannel evaporator is configured to operate at a temperature of no less than 30° F. such that formation of frost on the evaporator is substantially prevented.

An exemplary method for cooling a refrigerated merchandiser includes driving air through at least one microchannel evaporator using at least one axial flow fan, wherein the microchannel evaporator at least partially surrounds the at least one axial flow fan.

In another example of the above described method for cooling a refrigerated merchandiser the microchannel evaporator defines a profile at least partially matching a localized airflow generated by the at least one axial flow fan.

In another example of any of the above described methods for cooling a refrigerated merchandiser the at least one axial flow fan comprises a plurality of axial flow fans, and the at least one microchannel evaporator comprises a number of microchannel evaporators at least equal to the number of axial flow fans.

In another example of any of the above described methods for cooling a refrigerated merchandiser rein each of the microchannel evaporators in the plurality of microchannel heat exchangers is series connected to at least one other microchannel evaporators in the plurality of microchannel evaporators.

Another example of any of the above described methods for cooling a refrigerated merchandiser further includes providing an output of the microchannel evaporator to an air distribution passage.

In another example of any of the above described methods for cooling a refrigerated merchandiser the microchannel evaporator is configured to operate at a temperature of no less than 30° F. such that formation of frost on the evaporator is substantially prevented.

These and other features of the present invention can be best understood from the following specification and drawings, the following of which is a brief description.

DETAILED DESCRIPTION

Figure 1:
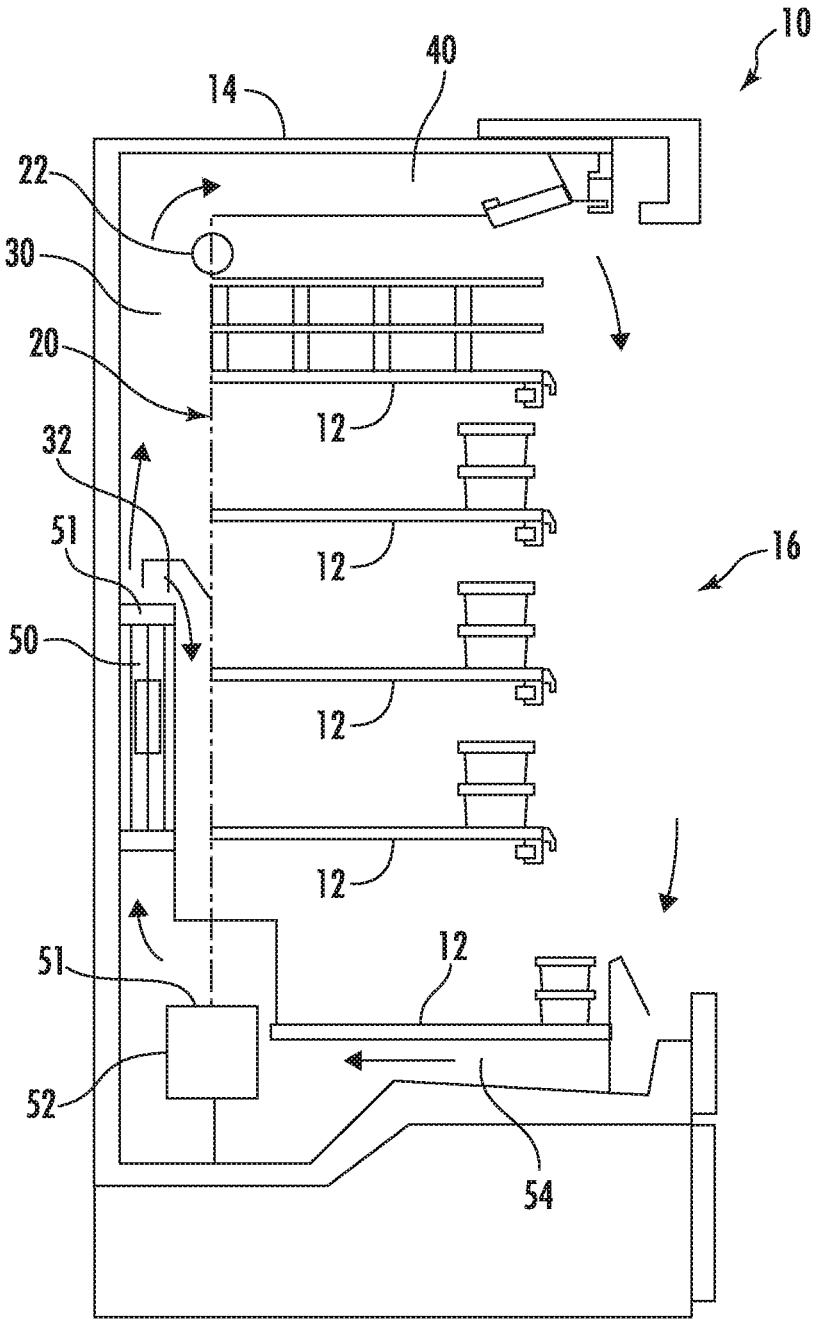
FIG. 1 PRIOR ART
FIG. 1 illustrates a prior art refrigerated display cabinet.

FIG. 1 schematically illustrates an exemplary prior art refrigerated display cabinet 10. The prior art cabinet 10 includes multiple shelves 12 contained within a cabinet housing 14. Each of the shelves 12 faces a front opening 16, and is supported at a rear end by a sheet metal distribution plate 20. The sheet metal distribution plate 20 defines a substantially vertical passage or duct 30 in the rear of the cabinet 10, and a substantially horizontal passage or duct 40 at the top of the cabinet 10. As there is no obstruction between the passage 30 and the passage 40, the two passages 30, 40 combine to define a single cooled air space. The distribution plate 20 includes multiple distribution holes 22 that allow cooled air to pass from the rear of the passage 30 into a corresponding shelf 12 region.

Also included within the passage 30 is a round-tube plate-fin heat exchanger 50 for cooling the air being provided to the shelves 12. A fan 52 is positioned immediately upstream of the heat exchanger 50 at an aft end of a return cavity 54 below the bottom most shelf 12. The fan 52 drives all of the air from the return cavity 54 to pass through the heat exchanger 50, thereby causing all of the air to be cooled. A downstream end 51 of the heat exchanger 50 expels cooled air into the passage 30. A portion of the air flows upward through the vertical passage 30 to the top passage 40 and the top shelves 12. A redirection feature 32 alters a flow direction of another portion of the cooled air by 180 degrees such that the redirected cooled air is provided to the lower shelves 12. While it is appreciated that the coolant cycle described with regards to a refrigerated cabinet such as the prior art cabinet, or any of the illustrated embodiments of the invention, is a circular cycle the description herein utilizes the upstream end of the air return cavity 54 as the "beginning" or "upstream most" end of the cycle, and the downstream portion of the air curtain as the "end" or "downstream most" end of the cycle.

The size of the gap 30 is dictated by the size of the heat exchanger 50, and the space between the heat exchanger 50 and the distribution plate 20 required to allow sufficient air to be provided to each shelf 12. Further, as all of the air is cooled by the single heat exchanger 50, the heat exchanger 50 must be sufficiently sized to cool all of the air to a temperature that remains below the required temperature until it reaches the farthest shelf 12 from the heat exchanger 50. This can result in overcooling the middle shelves in order to achieve the desired cooling at the top and/or bottom shelves 12. Even further still, the travel from the output of the heat exchanger 50 to each of the shelves 12 where the cooling is required causes the temperature of the air provided to the shelves 12 to be higher than the outlet temperature of the heat exchanger 50.

Figure 2:
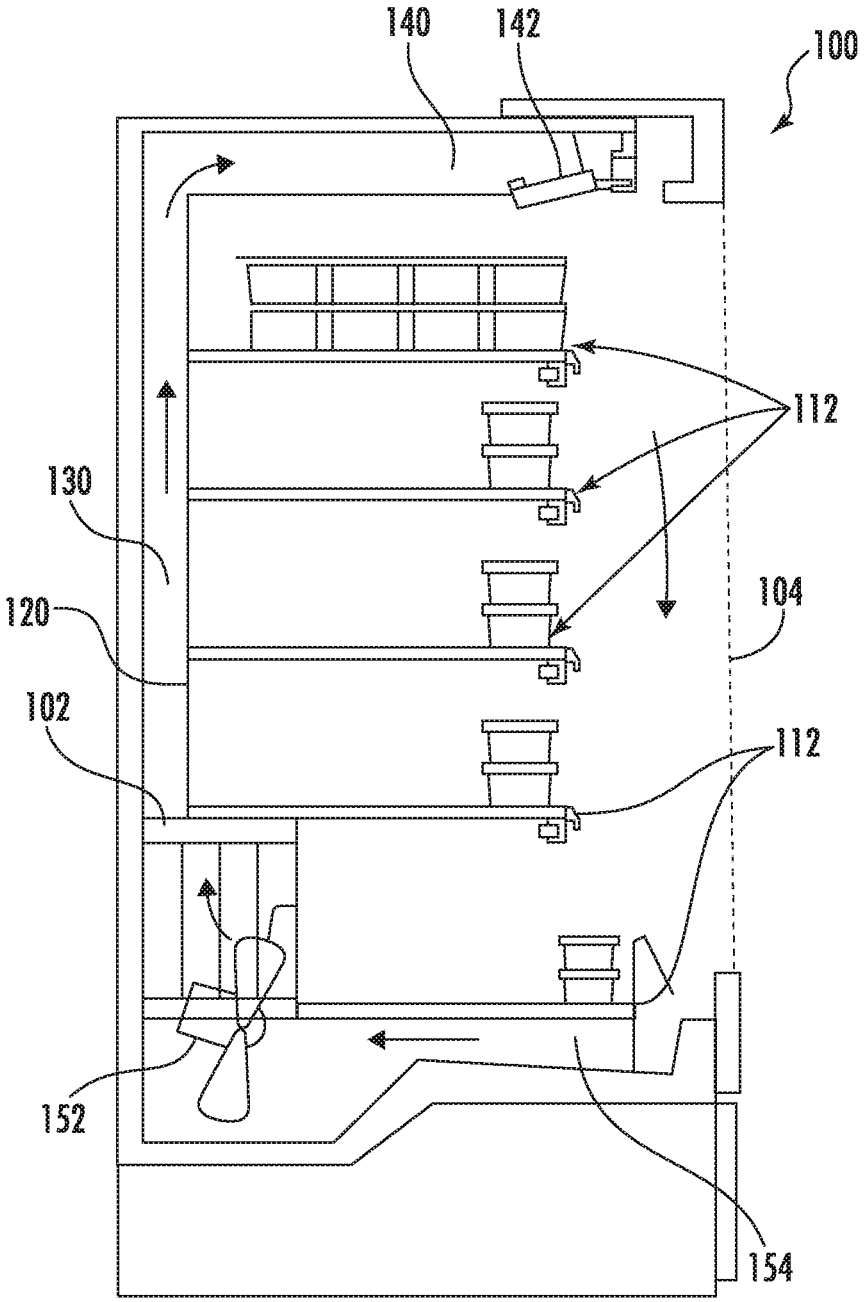
FIG. 2 schematically illustrates a side view of an exemplary refrigerated display cabinet including a microchannel heat exchanger.
Figure 3:
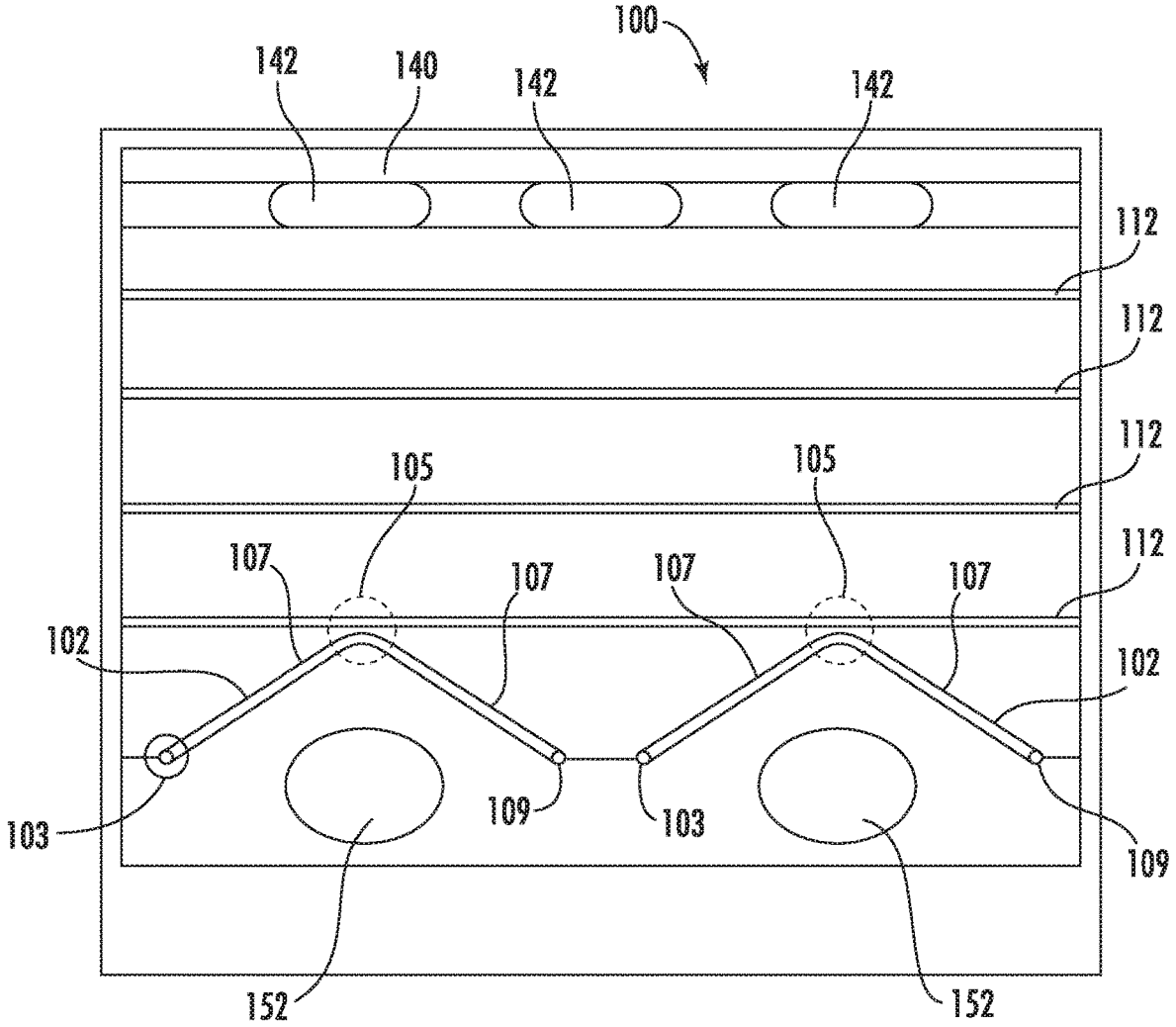
FIG. 3 schematically illustrates a front view of the exemplary refrigerated display cabinet of FIG. 2.
Figure 4:
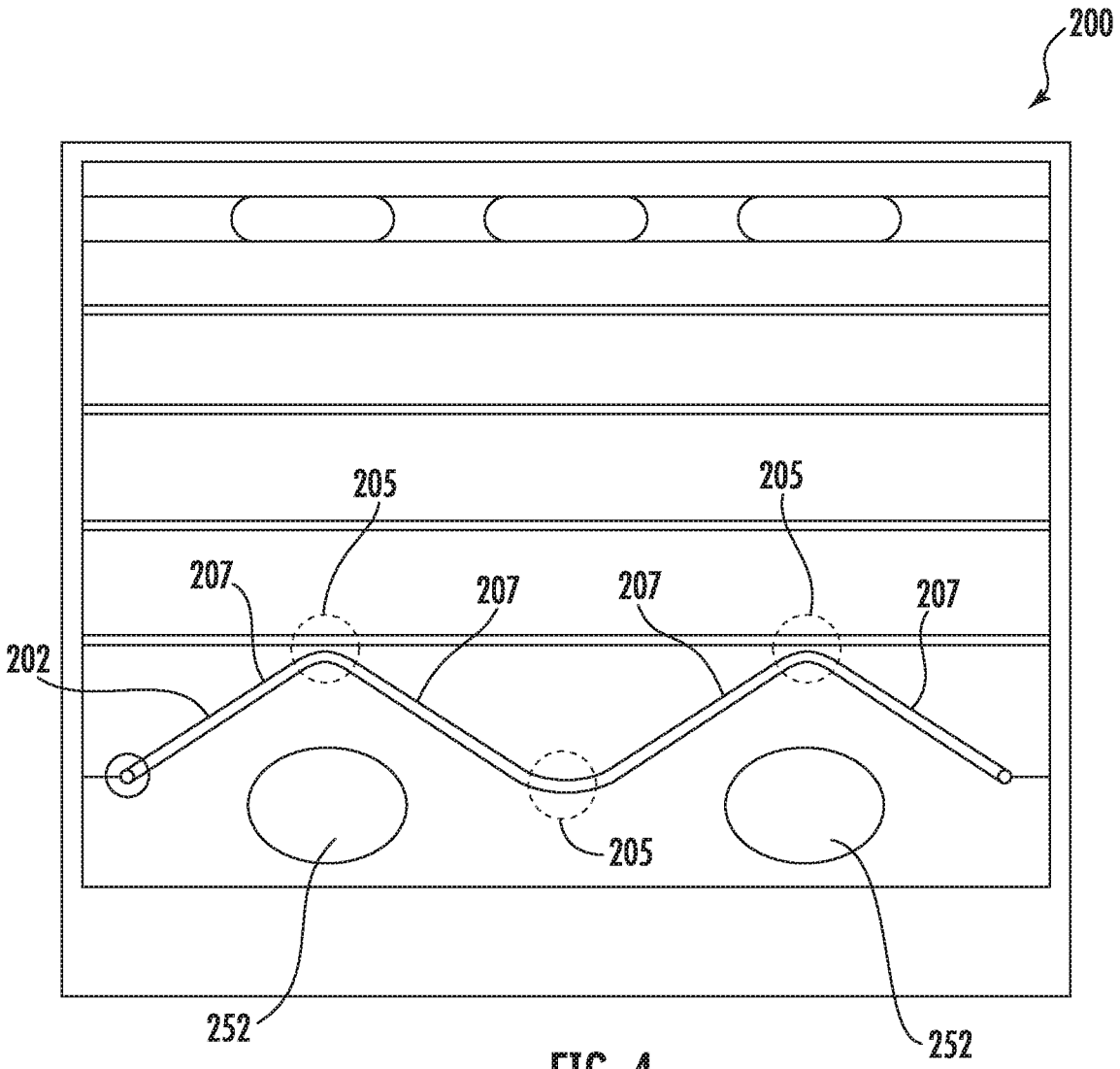
FIG. 4 schematically illustrates a front view of a second exemplary refrigerated display cabinet.

With reference to FIGS. 2-4, an exemplary refrigerated display cabinet 100 utilizing a modified flat-tube evaporator is illustrated. Such a merchandiser may be open or may be fitted with a glass door used in typical supermarkets and grocery stores for presenting fresh food and/or beverages to customers. In some examples, the evaporator is configured to operate at a temperature of no less than 30° F. such that formation of frost on the evaporator is substantially prevented. With reference to the refrigerated display cabinet 100, as discussed herein the "front" refers to a door 104 and relative positions like "back", "behind", "above", etc. are defined within this frame of reference for all examples.

The exemplary modified display case 100 utilizes a ribbon-bend formed flat-tube evaporator 102 in conjunction with an axial flow fan 152 positioned in such manner to minimize pressure losses and allow highly uniform air velocity pattern on the evaporator/heat exchanger 102 face which in turn maximizes thermal performance. A flat tube heat exchanger 102 includes an inlet manifold and an outlet manifold fluidly connected by a plurality of flat tubes. The flat tubes may be formed to include a plurality of channels, or internal passageways that are much smaller than the internal passageways of the tubes in the conventional round-tube plate-fin heat exchanger 50.

As used herein, the flat tubes may also comprise mini size multi-port channels, or micro size multi-port channels (otherwise known as microchannel tubes). Hence the flat tube heat exchangers using small size multi-port channels are alternately known as microchannel heat exchangers 102. In other constructions, the flat tubes may include one channel, or internal passageway. The microchannel heat exchanger 102 includes a plurality of secondary heat transfer surfaces in the form of serpentine-shape fins with louvers. The fins encompasses the width of the tube which also defines the minor dimension of the microchannel heat exchanger 102 and through which the air flows. The fins are positioned along the flat tubes and solidly coupled to two adjacent flat tubes by a brazing or welding process.

The cooling cycle of the refrigerated display cabinet 100 includes drawing air in through an air return cavity 154 using an axial flow fan 152. The output of the axial flow fan 152 is provided to the microchannel heat exchanger 102 which is positioned immediately downstream of, and partially surrounds, the axial flow fan 152. As air from the axial flow fan 152 passes through the microchannel heat exchanger 102, the air is cooled. The cooled air is expelled into an air distribution passage 130 defined behind the shelves 112. A portion of the cooled air passes through a distribution plate 120 to cool the corresponding shelves 112. The remainder of the air is provided to a top duct 140, and is directed downward by an air curtain fan 142 to create an air curtain in front of the shelves 112. The air from the shelves 112 and the air curtain is provided to the air return 154, and the cycle repeats.

One negative aspect of some microchannel heat exchangers is a requirement that airflow across the microchannel heat exchanger have a relatively even distribution to provide efficient cooling. The utilization of a fan, such as the axial flow fan 152 localizes airflows, resulting in uneven airflow across a given airflow path. The uneven airflow can result in inefficient microchannel heat exchanger operation if a flat microchannel heat exchanger is utilized immediately downstream of the fan.

With continued reference to FIG. 2, FIG. 3 schematically illustrates the refrigerated display cabinet 100 of FIG. 2 from a front view, and omitting the bottommost shelf 112 to illustrate features of the fans 152 and the microchannel heat exchangers 102. As can be seen, the fan 152 is, in the practical example, two fans 152, and the actual number of fans 152 utilized depends on the width of the refrigerated cabinet being created. Similarly, the air curtain is generated by multiple air curtain fans 142, with the number of air curtain fans 142 again depending on the width of the refrigerated display cabinet 100.

Figure 7:
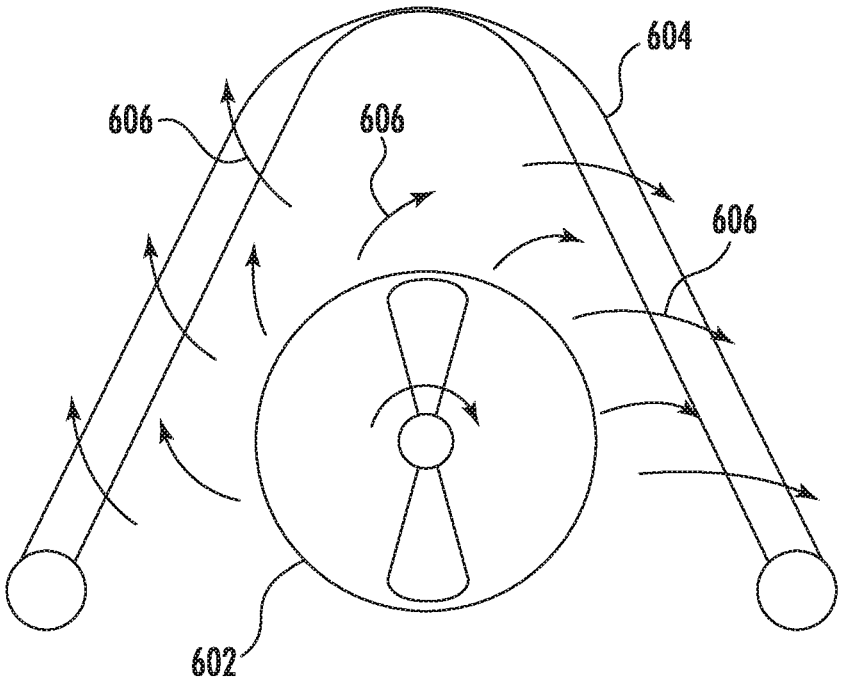
FIG. 7 schematically illustrates an example flow filed through an axial flow fan and a microchannel evaporator.

Each of the fans is partially surrounded by a corresponding microchannel heat exchanger 102, with the microchannel heat exchanger 102 including an inlet 103 connected to a bend 105 via a straight portion 107. The bend 105 is connected to an outlet 109 via a second straight portion 107. This configuration is referred to as an A-coil shape and utilizes unfinned tubes folded over to form the A shape. By placing multiple A-coils in series, as in the example of FIG. 2, a single M-coil is constructed. By disposing the fans 152 within a valley of the A-coil defined by the bend 105, the microchannel heat exchanger 102 more closely matches the localized swirling airflows generated by the axial flow fan 152, thereby improving the airflow uniformity and thus increasing the efficiency of the cooling. The matching of the flow from the fan with the microchannel heat exchanger is illustrated in FIG. 7 and described below.

Figure 5:
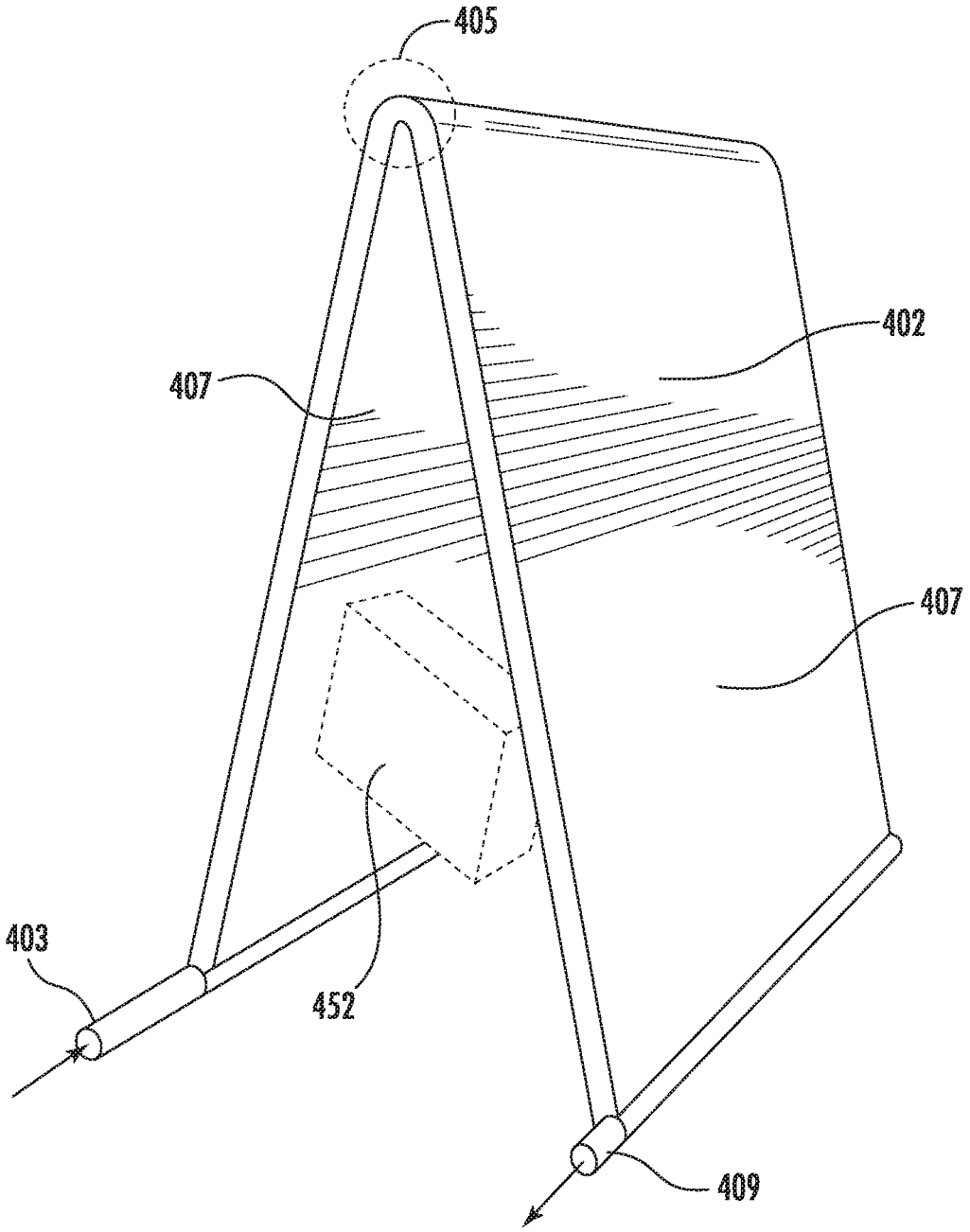
FIG. 5 schematically illustrates an isometric view of an exemplary A-frame microchannel heat exchanger.

With reference to the microchannel heat exchanger 102 of FIG. 3 specifically, FIG. 5 schematically illustrates an isometric example of a microchannel heat exchanger 402 including an inlet 403, flat portion 407, bend 405, second flat portions 407, and outlet 409. The microchannel heat exchanger 402 of FIG. 5 can be used as one of the A-coil micro channel heat exchangers 102 of FIG. 3, with a fan 452 disposed within the valley. In alternate examples, where less cooling may be necessary, the cabinet 100 can include a single fan 152, and a single corresponding A-coil microchannel heat exchanger 102.

With continued reference to FIGS. 2 and 3, and with like numerals indicating like elements, FIG. 4 schematically illustrates an example refrigerated cabinet 200 including two axial flow fans 252, each of which is partially surrounded by a single microchannel heat exchanger 202. The single microchannel heat exchanger 202 includes two bends 205 defining peaks, and a bend 205 defining a valley. Each of the fans 252 is disposed between flat portions 207 connected to a corresponding bend 205, such that the fan 252 is partially surrounded by the microchannel heat exchanger 202. In one example, each fan 252, and the corresponding flat portions 207 and bend 205 are identical to each other fan 252 and corresponding flat portions 207 and bend 205 within a single refrigerated display cabinet 200.

Figure 6:
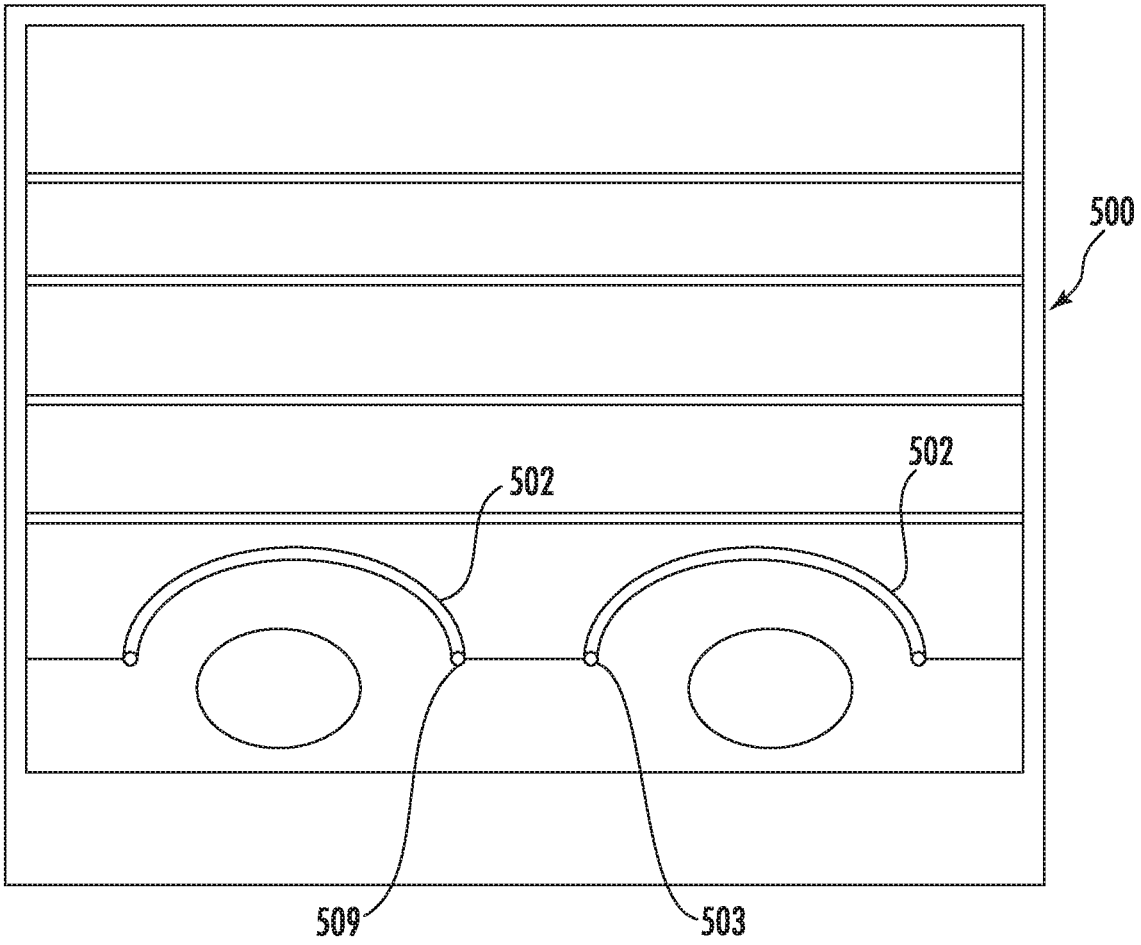
FIG. 6 schematically illustrates a front view of a third exemplary refrigerated display cabinet.

In yet another microchannel configuration, the flat portions of the microchannel heat exchangers can be omitted entirely by utilizing a larger curvature on the bend portion. FIG. 6 schematically illustrates an exemplary refrigerated display cabinet 500 including microchannel heat exchangers 502 configured in such a manner. In an alternate configuration of the example of FIG. 6, each of the microchannel heat exchangers 502 can be connected in series by incorporating a bend connecting the outlet 509 of the first microchannel heat exchanger 502 to the inlet 503 of the second microchannel heat exchanger.

With reference to all of FIGS. 2-6, the incorporation of a bend into the microchannel heat exchanger, and positioning of the fan within a valley defined by the bend provides the coolant system with a design module that consistently provides a set amount of cooling for a set energy cost. This in turn assists in the design and scalability process within a refrigerated cabinet product family by allowing the coolant cycle to be standardized and reducing the complexity of the design process. The creation of a single component set having a known cooling capability and energy cost is referred to as a modular design.

With continued reference to FIG. 2-6, FIG. 7 schematically illustrates an example flow filed through an axial flow fan 602 and a microchannel evaporator 604. As air flows through the axial flow fan 602, the fan 602 imparts a swirl into the flow field 606 of the air. By partially surrounding the axial flow fan 602 with the microchannel heat exchanger 604, the air passing through the microchannel heat exchanger 604 is traveling in a flow direction that closer to normal to the surface of the microchannel heat exchanger 604 across the microchannel heat exchanger 604. This is referred to as approximately matching the flow field and improves a uniformity of air temperature exiting the microchannel heat exchanger.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerated merchandiser comprising:

a product display area comprising a plurality of shelves;

an air return passage defined below the plurality of shelves;

a first fan disposed at a downstream end of the air return passage, wherein the first fan includes a first surface and a second surface, and wherein the first surface and the second surface are arranged on different positions along a circumference of the first fan, the circumference extending around an axis of rotation of the first fan;

an air distribution passage connected to an outlet of the first fan and disposed behind the plurality of shelves and a top passage disposed above the plurality of shelves;

at least one microchannel evaporator including a bend such that a valley is defined by a first section of the at least one microchannel evaporator on a first side of the bend, the bend, and a second section of the at least one microchannel evaporator on a second side of the bend, and wherein the first fan is disposed in the valley such that the at least one microchannel evaporator at least partially surrounds the first fan around a circumferential direction around the axis of rotation of the first fan with the first section facing the first surface of the first fan and the second section facing the second surface of the first fan, and the at least one microchannel evaporator defines a profile extending around multiple sides of the first fan;

wherein the at least one microchannel evaporator defines a flow profile at least partially matching a localized airflow generated by the first fan, and wherein the localized airflow is a swirl imparted on air exiting the first fan; and wherein the localized airflow of the first fan is a swirl imparted on the airflow by the first fan.

2. The refrigerated merchandiser of claim 1, wherein the bend is a single continuous bend that extends upward toward the top passage.

3. The refrigerated merchandiser of claim 1, wherein the first section comprises a first straight portion and the second section comprises a second straight portion, the first straight portion being connected to the second straight portion via the bend.

4. The refrigerated merchandiser of claim 1, further comprising a second fan at the downstream end of the air return passage, wherein the at least one microchannel evaporator at least partially surrounds opposing sides of the second fan.

5. The refrigerated merchandiser of claim 4, wherein the at least one microchannel evaporator includes a first microchannel evaporator surrounding opposing sides of the first fan and a second microchannel evaporator surrounding opposing sides of the second fan.

6. The refrigerated merchandiser of claim 5, wherein an outlet of the first microchannel evaporator is connected to an inlet of the second microchannel evaporator such that the first and second microchannel evaporators are arranged in series.

7. The refrigerated merchandiser of claim 5, wherein each of the first and second microchannel evaporators are A-coil microchannel heat exchangers.

8. The refrigerated merchandiser of claim 5, wherein each of the first and second microchannel evaporators are defined by a single bend portion and a lack of straight portions.

9. The refrigerated merchandiser of claim 1, wherein the at least one microchannel evaporator is positioned relative to the first fan such that a physical orientation of the at least one microchannel evaporator matches localized airflows generated by the first fan, and wherein the localized airflows generated by the first fan are a swirl imparted on a general airflow by the first fan.

10. The refrigerated merchandiser of claim 1, wherein the first fan is an axial flow fan.

11. The refrigerated merchandiser of claim 1, wherein the at least one microchannel evaporator is configured to operate at a temperature of no less than 30° F. such that formation of frost on the at least one microchannel evaporator is substantially prevented.

12. The refrigerated merchandiser of claim 1, wherein the first surface of the first fan comprises a first side that faces the first section and the second surface of the first fan comprises a second side that faces the second section, and wherein the at least one microchannel evaporator has an inlet to the first section and an outlet from the second section, and wherein the first fan is disposed in the valley such that a third side of the first fan, which extends between the first side and the second side, faces the bend and a fourth side of the first fan, extending between the first side and the second side, faces opposite of the third side, and wherein the inlet and the outlet extend beyond the fourth side of the first fan.

13. The refrigerated merchandiser of claim 1, including a housing within which the plurality of shelves are received, and wherein the air return passage extends along a bottom of the housing, and wherein the bend extends upward toward the top passage and defines an apex of the valley, and wherein the first section, the apex, and the second section have a concave side and a convex side, and wherein the concave side faces the bottom of the housing while the housing is in an upright orientation.

14. The refrigerated merchandiser of claim 13, wherein the first fan faces a front opening of the housing.

15. The refrigerated merchandiser of claim 1, wherein the at least one microchannel evaporator is configured such that a first portion of an air flow exiting the first fan passes through the first side of the bend and a second portion of the air flow exiting the first fan passes through the second side of the bend, and wherein the first portion and the second portion of the air flow exiting the first fan are distinct portions of the air flow exiting the first fan.

16. The refrigerated merchandiser of claim 1, wherein the first section of the at least one microchannel evaporator on the first side of the bend and the second section of the at least one microchannel evaporator on the second side of the bend are directly connected to the bend such that the profile extends around opposing sides of the first fan.

17. A refrigerated merchandiser comprising:

a product display area comprising a plurality of shelves;

an air return passage defined below the plurality of shelves;

a first fan disposed at a downstream end of the air return passage, wherein the first fan includes a first surface and a second surface, and wherein the first surface and the second surface are arranged on different positions along a circumference of the first fan, the circumference extending around an axis of rotation of the first fan;

an air distribution passage connected to an outlet of the first fan and disposed behind the plurality of shelves and a top passage disposed above the plurality of shelves;

at least one microchannel evaporator including a first bend such that a first valley is defined by a first section of the at least one microchannel evaporator on a first side of the first bend, the first bend, and a second section of the at least one microchannel evaporator on a second side of the first bend, and wherein the first fan is disposed in the first valley such that the at least one microchannel evaporator at least partially surrounds the first fan around a circumferential direction around the axis of rotation of the first fan with the first section facing the first surface of the first fan and the second section facing the second surface of the first fan, and the at least one microchannel evaporator defines a profile extending around multiple sides of the first fan;

a second fan at the downstream end of the air return passage, wherein the at least one microchannel evaporator at least partially surrounds opposing sides of the second fan; and wherein the at least one microchannel evaporator comprises a single microchannel evaporator including the first bend defining the first valley, a second bend defining a second valley, and a third bend defining a third valley between said first bend and said second bend, and wherein the first valley comprises a first peak and the second valley comprises a second peak that each extend upward toward the top passage and the third bend extends downward toward the air return passage.

18. The refrigerated merchandiser of claim 17, further comprising a first straight portion connecting the first bend to the third bend, a second straight portion connecting the third bend to the second bend, a third straight portion extending from an inlet and connecting to the first bend, and a fourth straight portion extending from the second bend to an outlet.

19. The refrigerated merchandiser of claim 17, wherein the first bend is connected directly to the third bend and the third bend is connected directly to the second bend.

20. A method for cooling a refrigerated merchandiser comprising:

driving air through at least one microchannel evaporator using at least one axial flow fan, and wherein the at least one axial flow fan includes a first surface and a second surface, and wherein the first surface and the second surface are arranged on different positions along a circumference of the at least one axial flow fan, the circumference extending around an axis of rotation of the at least one axial flow fan, the at least one microchannel evaporator including a bend such that a valley is defined by a first section of the at least one microchannel evaporator on a first side of the bend, the bend, and a second section of the at least one microchannel evaporator on a second side of the bend, and wherein the at least one axial flow fan is disposed in the valley such that the at least one microchannel evaporator defines a profile extending around multiple sides of the at least one axial flow fan with the first section facing the first surface of the at least one axial flow fan and the second section facing the second surface of the at least one axial flow fan, such that the at least one microchannel evaporator at least partially surrounds the at least one axial flow fan around a circumferential direction around the axis of rotation of the at least one axial flow fan; and the at least one microchannel evaporator defining a flow profile at least partially matching a localized airflow generated by the at least one axial flow fan, and wherein the localized airflow is a swirl imparted on air exiting the at least one axial flow fan, and wherein the localized airflow of the at least one axial flow fan is a swirl imparted on the airflow by the at least one axial flow fan.

21. The method of claim 20, wherein the at least one axial flow fan comprises a plurality of axial flow fans, and the at least one microchannel evaporator comprises a number of microchannel evaporators at least equal to the number of axial flow fans.

22. The method of claim 21, wherein each of the microchannel evaporators in the number of microchannel evaporators is series connected to at least one other microchannel evaporator in the number of microchannel evaporators.

23. The method of claim 20, further comprising providing an output of the at least one microchannel evaporator to an air distribution passage.

24. The method of claim 20, wherein the at least one microchannel evaporator is configured to operate at a temperature of no less than 30° F. such that formation of frost on the at least one microchannel evaporator is substantially prevented.

25. The method of claim 20, wherein the bend defines an apex of the valley, with the first section, the apex, and the second section having a concave side and a convex side, and the method including positioning the at least one microchannel evaporator in a housing, extending a top passage above a plurality of shelves positioned within the refrigerated merchandiser, extending an air return passage along a bottom of the housing, and positioning the concave side to face the bottom of the housing with the bend extending upwardly toward the top passage while the housing is in an upright orientation.

26. The method of claim 25, including positioning the at least one axial flow fan to face a front opening of the housing.

27. A method for cooling a refrigerated merchandiser comprising:

driving air through at least one microchannel evaporator using at least one axial flow fan, and wherein the at least one axial flow fan includes a first surface and a second surface facing opposite the first surface, the at least one microchannel evaporator including a bend such that a valley is defined by a first section of the at least one microchannel evaporator on a first side of the bend, the bend, and a second section of the at least one microchannel evaporator on a second side of the bend, and wherein the at least one axial flow fan is disposed in the valley such that the at least one microchannel evaporator defines a profile extending around multiple sides of the at least one axial flow fan with the first section facing the first surface of the at least one axial flow fan and the second section facing the second surface of the at least one axial flow fan, wherein the at least one microchannel evaporator includes a single microchannel evaporator including a first bend defining a first peak, a second bend defining a second peak, and a third bend defining a valley between said first bend and said second bend, and wherein the first peak and the second peak extend upward toward a top passage disposed above a plurality of shelves and the third bend extends downward toward an air return passage defined below the plurality of shelves.

* * * * *